United States Patent [19]

Zengerle

[11] Patent Number: 4,885,234

[45] Date of Patent: Dec. 5, 1989

[54] PHOTOGRAPHIC MATERIALS CONTAINING STABLE CYAN COUPLER FORMULATIONS

[75] Inventor: Paul L. Zengerle, Rochester, N.Y.

[73] Assignee: Eastman Kodak Company, Rochester, N.Y.

[21] Appl. No.: 251,533

[22] Filed: Sep. 29, 1988

[51] Int. Cl.[4] ..... G03C 7/34

[52] U.S. Cl. ..... 430/546; 430/549; 430/552

[58] Field of Search ..... 430/546, 549, 552

[56] References Cited

U.S. PATENT DOCUMENTS

| | | | |
|---|---|---|---|
| 2,533,514 | 9/1950 | Sawdey et al. | 430/546 |
| 2,801,171 | 1/1957 | Fierke et al. | 430/546 |
| 4,333,999 | 7/1982 | Lau | 430/17 |
| 4,451,558 | 3/1984 | Sugita et al. | 430/546 |
| 4,518,683 | 11/1985 | Kato et al. | 430/546 |
| 4,775,616 | 10/1988 | Kilminster et al. | 430/552 |

FOREIGN PATENT DOCUMENTS 59-24848 2/1984 Japan .

*Primary Examiner*—Richard L. Schilling
*Attorney, Agent, or Firm*—Thomas F. Kirchoff

[57] ABSTRACT

The present invention describes photographic materials containing stable phenolic cyan dye-forming coupler formulations which include a coupler having a p-cyanophenylureido group in the 2 position and an acylamino ballast having a sulfone group in the 5-position of the phenolic ring.

18 Claims, No Drawings

PHOTOGRAPHIC MATERIALS CONTAINING STABLE CYAN COUPLER FORMULATIONS

The present invention relates to photographic elements and emulsions which contain stable cyan dye-forming coupler formulations.

U.S. Pat. No. 4,333,999 describes cyan phenolic couplers which comprise a p-cyanophenylureido group in the 2-position of the phenolic ring. This class of couplers has found wide acceptance in photographic appliations. Included among the important advantages of these couplers is their ability toyield dyes having excellent purity and hues which are shifted bathochromically to long wavelengths in the red region of the visible spectrum. These desirable properties provide dyes which absorb relatively small amounts of green light.

More recently, improved cyan dye-forming couplers have been found which provide still further advantages, including enhanced coupling reactivity and high dye extinction coefficients. These improved couplers are described in copending U.S. application Ser. No. 940,829 of Kilminster and Hoke, filed Dec. 12, 1986, now U.S. Pat. No. 4,775,616.

Although couplers of the '829 application provide the additional advantages noted above, some couplers falling within the '829 disclosure have proven to be difficult to formulate into stable compositions using conventional coupler solvents. Crystallization has been encountered during cold storage. Storage problems also lead to reduced coupler reactivity and viscosity increases.

Preparation of photographic materials containing coupler compounds usually involves incorporation of one or more couplers, in coupler solvent, in emulsion layers as an oil-in-water dispersion. A commonly used coupler solvent is N,N-diethyllaurylamide. While such solvent provides adequate formulationstability, this solvent choice has been found to cause loss of coupler reactivity, thereby offsetting a principal advantage of the '829 type couplers.

Accordingly, problems with respect to coupler dispersion stability and loss of coupler reactivity adversely affect use of particular couplers described in the aforementioned '829 application.

The objectives of this invention are to provide stable photographic material comprising a cyan dye-forming coupler compound having a sulfone group in the ballast portion thereof without loss of desirable photographic properties.

These objectives are provided in accordance with the present invention which provides a photographic recording material comprising a support and a photosensitive silver halide emulsion which has associated therewith (1) a cyan dye-forming coupler component which comprises (a) from about 20 to 100% by weight of a sulfone group containing coupler having the structure of Formula (I):

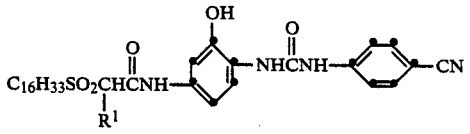

(I)

wherein:

$R^1$ is alkyl having 2 or 3 carbon atoms, and (b) up to about 80% by weight of a coupler compound having the structure of Formula (II):

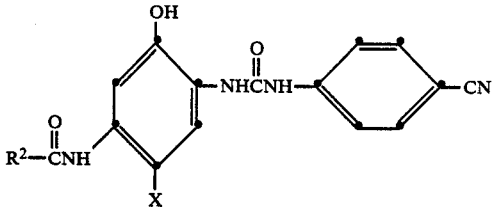

(II)

wherein:

$R^2$ is a ballast group; and

X is hydrogen or a coupling-off group, said coupler component being dispersed in (2) a coupler solvent component which comprises (c) from 1 to about 50% by weight of N,N-diethyllauramide and (d) from about 50 to about 99% by weight of at least one of a phosphoric acid ester and a dialkyl phthalate compound.

Coupler compounds comprising a sulfone group and which are suitable for use in this invention are described in U.S. application Ser. No. 940,829, now U.S. Pat. No. 4,775,616, of Kilminster and Hoke, filed Dec. 12, 1986 the disclosure of which is hereby incorporated by reference. Such compounds, as can be recognized from Formula (I) noted above, comprise structures where $R^1$ in the ballast moiety is either an ethyl or a propyl group.

Specific coupler compounds falling within the structure of Formula I are as follows:

Coupler

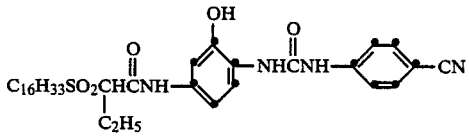

A

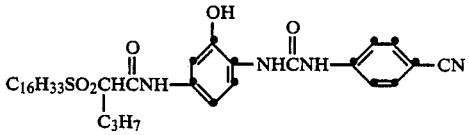

B

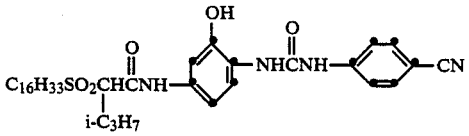

C

Where $R^1$ is an alkyl group larger than propyl, the dispersion stability problems noted above are not encountered.

A preferred concentration of the coupler of Formula (I) is from about 70 to about 95% by weight of the total coupler component. Within this range the optimum combinaton of desirable coupler properties is obtained.

Coupler compounds falling within the structure of Formula (II) are fully described in U.S. Pat. No. 4,333,999, the disclosure of which is incorporated herein by reference.

These coupler compounds include coupling-off groups, defined by X in Formula II. Such groups are well known to those skilled in the art and determine the equivalency of the coupler (i.e. whether it is a twoequivalent or a four-equivalent coupler). Such groups also modify the reactivity of the coupler, and can advantageously affect the layer in which the coupler is coated or other layers in the element by performing, after release from the coupler, such functions as development inhibition, bleach inhibition, bleach acceleration, color correction and the like. Representative classes of coupling-off groups include halogen, alkoxy, aryloxy, heteroyloxy, sulfonyloxy, acyloxy, acyl, heteroyl, thiocyano, alkylthio, arylthio, heteroylthio, sulfonamido, phosphonyloxy and arylazo. They are described for example, in U.S. Pat. Nos. 2,455,169; 3,227,551; 3,432,521; 3,476,563; 3,617,291; 3,880,661; 4,052,212 and 4,134,766; and in U. K. Patents and published application Nos. 1,466,728; 1,531,927; 1,533,039; 2,006,755A and 2,017,704:; the disclosures of which are incorporated herein by reference.

Examples of specific coupling-off groups are:

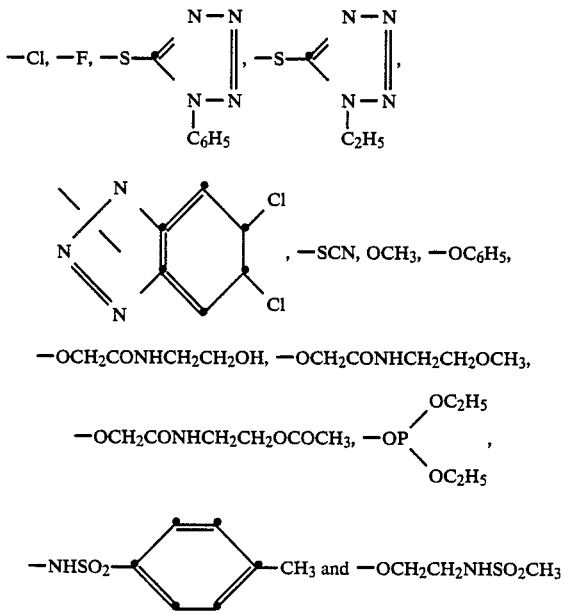

The ballast group defined by $R^2$ is an organic radical of such size and configuration as to confer on the coupler molecule sufficient bulk to render the coupler substantially non-diffusible from the layer in which it is coated in a photographic element. Representative ballast groups include substituted or unsubstituted alkyl or aryl groups containing a total of 8 to 32 carbon atoms. Representative substituents include alkyl, aryl, alkoxy, aryloxy, alkylthio, arylthio, hydroxy, halogen, alkoxycarbonyl, aryloxycarbonyl, carboxy, acyl, acyloxy, carbonamido, carbamoyl, alkylsulfonyl, arylsulfonyl, sulfonamido, and sulfamoyl groups wherein the alkyl and aryl substituents, and the alkyl and aryl portions of the alkoxy, aryloxy, alkylthio, arylthio, alkoxycarbonyl, arylcarbonyl, acyl, acloxy, carbonamido, carbamoyl, alkylsulfonyl, arylsulfonyl, sulfonamido and sulfamoyl substituents contain 1 to 30 carbon atoms and 6 to 30 carbon atoms, respectively, and can be further substituted with such substituents.

A preferred concentration of coupler of Formula (II) structure is from about 5 to about 30% by weight of the coupler component. Such preference is for the same reasons noted above regarding coupler having the structure of Formula (I).

Preferred Formula (II) type couplers include those falling within the structure of Formula (III):

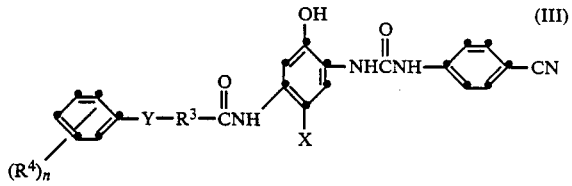

(III)

wherein:

X is as defined above;

Y is oxygen or sulfur;

$R^3$ is a branched alkylene group of 2 to 20 carbon atoms, i.e., a secondary or tertiary alkylene;

$R^4$ is hydroxy, carboxy, alkyl, aryl, aralkyl, alkoxyl, aryloxy, alkylsulfamoyl, arylsulfamoyl, alkylsulfonamido, arylsulfonamido, alkylsulfonyl, arylsulfonyl, alkoxycarbonyl, or acyloxy wherein the alkyl moieties of these groups contain 1 to 20 carbon atoms and the aryl moieties contain 6 to 20 carbon atoms and wherein the alkyl, aryl and aralkyl moieties can be further substituted with hydroxy, carboxy, alkoxycarbonyl or acyloxy; and n is 1 to 3.

Especially preferred are those couplers where $R^4$ is straight or branched chain alkyl of 1 to 20 carbon atoms and n is 1 or 2.

Specific Formula II type couplers suitable for use in this invention are shown in Table I:

TABLE 1

| Coupler Number | X | $R^2$ |
|---|---|---|
| 1 | —H | 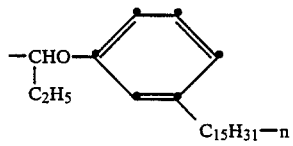 |
| 2 | —Cl | 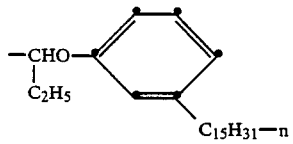 |

TABLE 1-continued
| | | |
|---|---|---|
| 3 | —H | 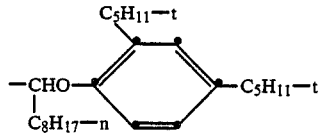 |
| 4 | —H | 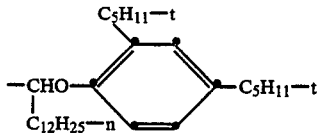 |
| 5 | —H | 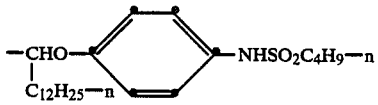 |
| 6 | —H | 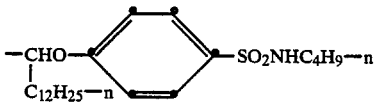 |
| 7 | —H | 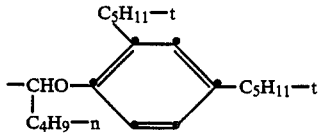 |
| 8 | —Cl | 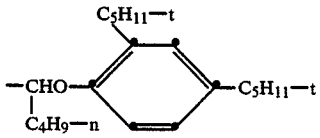 |
| Coupler Number | X | R |
|---|---|---|
| 9 | —H | 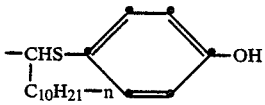 |
| 10 | —H | 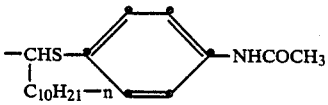 |
| 11 | —Cl | 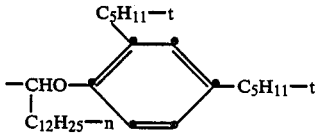 |
| 12 | —F | 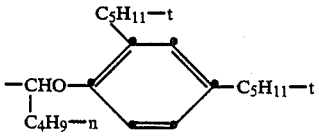 |
| 13 | —H | 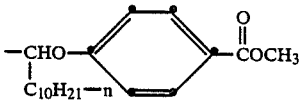 |

TABLE 1-continued

| | | |
|---|---|---|
| 14 | —H | 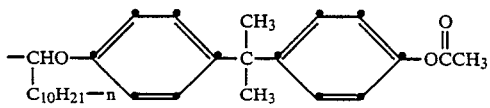 |
| 15 | —H | 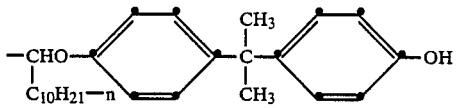 |
| 16 | —H | 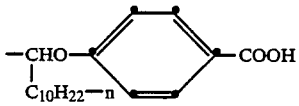 |
| 17 | 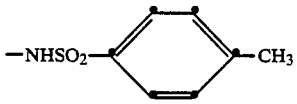 | 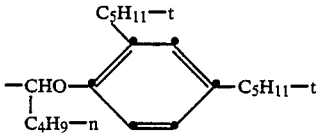 |

Couplers employed in this invention can be prepared by procedures described, respectively, in aforementioned U.S. application Ser. No. 940,829 and in U.S. Pat. No. 4,333,999.

The coupler solvent component comprises a mixture of N,N-diethyllauramide and a solvent which includes at least one of a phosphoric acid ester compound or a dialkyl phthalate compound.

N,N-diethyllauramide is a well known coupler solvent and is described as such in U.S. Pat. No. 2,533,514. This solvent has found commercial utility as employed with a large number and variety of photographic dye-forming coupler compounds.

A preferred concentration of N,N-diethyllauramide is from about 5 to about 25% of the total solvent component since maximum formulation stability and minumum loss in coupler reactivity is obtained within this range.

Phosphoric acid esters are also well known as coupler solvents and a variety of such esters are disclosed in U.S. Pat. No. 2,322,027, the disclosure of which is incorporated herein by reference. These compounds include both aliphatic and aromatic esters, such as for example:

tri-n-hexyl phosphate
di-n-octyl phosphate
tri-n-octyl phosphate
diphenyl phosphate
tri-p-t-butylphenyl phosphate
triphenyl phosphate
tricresyl phosphate.

Dialkyl phthalate compounds are equally well known as coupler solvents in photographic applications. Typical examples of these compounds are described in U.S. Pat. No. 2,304,940, the disclosure of which is incorporated herein by reference. Examples include esters where at least one of the alkyl moieties has from 1 to 18, or more, carbon atoms. Illustrative examples include;

dimethyl phthalate
di-n-butyl phthalate
di-i-butyl phthalate
di-t-butyl phthalate
di-n-amyl phthalate
di-i-hexyl phthalate
di-n-octyl phthalate
di-n-decyl phthalate
di-s-dodecyl phthalate.

When the preferred range of from about 5 to about 25% by weight of N,N-diethyllauramide is employed, the concentration of remaining coupler solvent will be from about 75 to about 95% by weight of solvent component.

This invention also relates to a photographic emulsion which comprises photosensitive silver halide having associated therewith (1) a cyan dye-forming coupler component which comprises (a) from about 20 to 100% by weight of a sulfone group containing coupler having the structure of Formula (I):

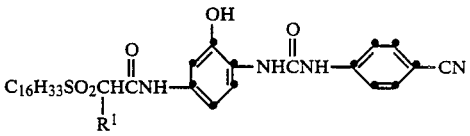

(I)

wherein:

$R^1$ is alkyl having 2 or 3 carbon atoms, and (b) up to about 80% by weight of a coupler compound having the structure of Formula (II):

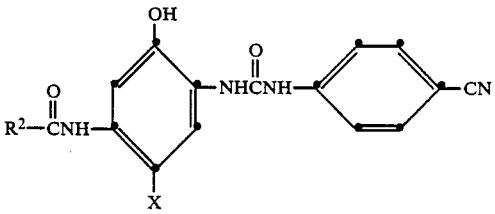

(II)

wherein:

$R^2$ is a ballast group; and

X is hydrogen or a coupling-off group, said coupler component being dispersed in (2) a coupler solvent component which comprises (c) from 1 to about 50% by weight of N,N-diethyllauramide and (d) from about 50 to about 99% by weight of at least one of a phosphoric acid ester and a dialkyl phthalate compound.

The cyan dye-forming couplers of this invention can be used in the ways and for the purposes that cyan dye-forming couplers are used in the photographic art. Typically, the couplers are incorporated in silver halide emulsions and the emulsions are coated on a support to form a photographic element. Alternatively, the couplers can be incorporated in other layers of photographic elements adjacent a silver halide emulsion layer where, during development, the coupler will be in reactive association with development products such as oxidized color developing agent.

There are no special restrictions with respect to the amount of coupler component in comparison with the amount of coupler solvent component. Generally, it is desirable that with respect to each 100 parts by weight of cyan coupler there be from about 0.05 to about 500 parts, preferably from about 30 to about 150 parts, by weight of coupler solvent.

As used herein, the term "associated therewith" signifies that the coupler is in the silver halide emulsion layer or in an adjacent location where, during processing, it is capable of reacting with silver halide development products.

The photographic elements can be either single color or multicolor elements. In a multicolor element, the cyan dye-forming coupler of this invention is usually associated with a red-sensitive emulsion, although it could be associated with an unsensitized emulsion or an emulsion sensitized to a different region of the spectrum. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, at least one of the cyan dye-forming couplers being a coupler of this invention, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the elements of this invention, reference will be made to *Research Disclosure,* December 1978, Item 17643, published by Industrial Opportunities Ltd., Homewell Havant, Hampshire, P09 1EF, U.K., the disclosures of which are incorporated herein by reference. This publication will be identified hereafter by the term "Research Disclosure."

The silver halide emulsions employed in the elements of this invention can be either negative-working or positive-working. Suitable emulsions and their preparation are described in *Research Disclosure* Sections I and II and the publications cited therein. Suitable vehicles for the emulsion layers and other layers of elements of this invention are described in *Research Disclosure* Section IX and the publications cited therein.

In addition to the couplers described herein the elements of this invention can include additional couplers as described in *Research Disclosure* Section VII, paragraphs D, E, F and G and the publications cited therein. These additional couplers can be incorporated as described in *Research Disclosures* of Section VII, paragraph C and the publications cited therein.

The photographic elements of this invention can contain brighteners (*Research Disclosure* Section V), antifoggants and stablizers (*Research Disclosure* Section VI), antistain agents and image dye stabilizers (*Research Disclosure* Section VII, paragraphs I and J), light absorbing and scattering materials (*Research Disclosure* Section VIII), hardeners (*Research Disclosure* Section XI), plasticizers and lubricants (*Research Disclosure* Section XII), antistatic agents (*Research Disclosure* XIII), matting agents (*Research Disclosure* Section XVI) and development modifiers (*Research Disclosure* (Section XXI).

The photographic elements can be coated on a variety of supports as described in *Research Disclosure* Section SVII and the references described therein.

Photographic elements can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are 4-amino-3-methyl-N,N-diethylaniline hydrochloride, 4-amino-3-methyl-N-ethyl-N-$\beta$-(methanesulfonamido)ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl-N-diethylaniline hydrochloride and 4-amino-N-ethyl-N-(2-methoxyethyl)-m-toluidine di-p-toluene sulfonic acid.

With negative working silver halide this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and siler halide, washing and drying.

The following examples further illustrate the invention.

EXAMPLE 1

Dispersion formulation were prepared comprising varying concentrations of coupler and of solvent components. Each formulation was stored for 6 weeks at 5° C. after which viscosity measurements, reported in centipoises (cps) were made immediately and over time periods as indicated below in Table 2 while holding the dispersions at 45° C.

Numbers in parentheses represent the ratio by weight of the respective components.

TABLE 2

| BLEND | COUPLERS FORMULA I | COUPLERS FORMULA II | SOLVENTS DELA[a] | SOLVENTS DNBP[b] | Time in Minutes Held at 45° C. 0 min. | 45 min. | 150 min. | 270 min. |
|---|---|---|---|---|---|---|---|---|
| 1 | B (1) | — | — | (1) | 54.5 cps | 104.0 cps | * | * |
| 2 | B (9) | 7 (1) | — | (10) | 34.6 cps | 40.8 cps | 59.0 cps | 62.0 cps |
| 3 | B (10) | — | (1) | (9) | 34.0 cps | 35.3 cps | 45.3 cps | 52.0 cps |
| 4 | B (9) | 7 (1) | (1) | (9) | 36.4 cps | 35.0 cps | 34.0 cps | 33.5 cps |

[a]N,N—diethyllauramide
[b]di-n-butylphthalate
*solidified

From Table 2 it can be seen that formulation stability is improved when blends of coupler compounds and/or of solvent compounds is employed and is best when both the coupler and the coupler solvent is blended.

EXAMPLE 2

The effect of variations of both coupler and solvent usage on coupler reactivity over time is demonstrated by results reported in TABLE 3. Coupling rate constants (Kc) for a coupler, or a blend of couplers, $dm^3m^{-1}s^{-1}$, were measured using an aqueous competition test with sulfite ion over a period of cold storage (5° C.). Results are recorded in Table 3 as $dm^3c^{-1}s^{-1}$ and are compared to that of Coupler B dispersed in di-n-butylphthalate (Blend 5). Numbers in parentheses represent the ratio by weight of the respective components.

TABLE 3

| BLEND | COUPLER FORMULA I | COUPLER FORMULA II | SOLVENT DELA[a] | SOLVENT DNBP[b] | COUPLING REACTIVITY RATE ($dm^3m^{-1}s^{-1}$) 5 days | 14 days | 21 days | 28 days | 35 days |
|---|---|---|---|---|---|---|---|---|---|
| 5 | B (1) | — | — | (1) | 12112 | 11036 | 10133 | 9009 | 8378 |
| 6 | B (9) | 7 (1) | — | (10) | 11851 | 11867 | 11279 | 10571 | 9508 |
| 7 | B (10) | — | (1) | (9) | 11378 | 11500 | 11153 | 10858 | 10605 |
| 8 | B (9) | 7 (1) | (1) | (9) | 10761 | 10810 | 10560 | 10567 | 10369 |

[a]N,N—diethyllauramide
[b]di-n-butylphthalate

TABLE 3 shows the improvement in dispersion stability over an extended time period as the result of using blends of solvents with Coupler B or with a blend of couplers including Coupler B.

EXAMPLE 3

Results reflected in TABLE 4 below show the effects on coupler reactivity of varying amounts of coupler solvent components on a coupler falling within the description of structural Formula 1 and on a mix of couplers falling within the structures of Formulae I and II. Coupler reactivity values were determined in the same manner as used in Example 2. The numbers in parentheses represent the weight ratio of couplers employed.

TABLE 4

| Blend | % by WEIGHT OF SOLVENT DELA[a] | DNBP[b] | COUPLER B | B:7(9:1) |
|---|---|---|---|---|
| 9 | 0 | 100 | 12112 | 11851 |
| 10 | 5 | 95 | 11663 | 11645 |
| 11 | 10 | 90 | 11378 | 10761 |
| 12 | 25 | 75 | 9812 | 9406 |
| 13 | 50 | 50 | 7221 | 6881 |
| 14 | 100 | 0 | 3846 | 3666 |

[a]N,N—diethyllauramide
[b]di-n-butylphthalate

From Table 4 it can be seen that as the level of N,N-diethyllauramide solvent increases there is a corresponding decrease in coupler reactivity, whether the coupler component comprises a single coupler or mixed couplers. This necessitates the use of solvent blends to maintain high coupler reactivity while achieving improved stability.

This invention has been described in detail with particular reference to preferred embodiments thereof, but it will be understood that variations and modifications can be effected within the spirit and scope of the invention.

What is claimed is:

1. A photographic recording material comprising a support and a photosensitive silver halide emulsion which has associated therewith (1) a cyan dye-forming coupler component comprising (a) from about 20 to 100% by weight of a sulfone group containing coupler compound having the structural formula:

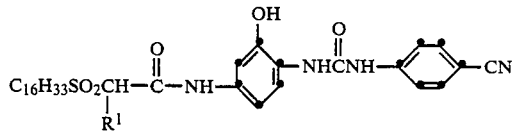

(I)

wherein:

$R^1$ is alkyl having 2 or 3 carbon atoms; and (b) up to about 80% by weight of a coupler compound having the structural formula:

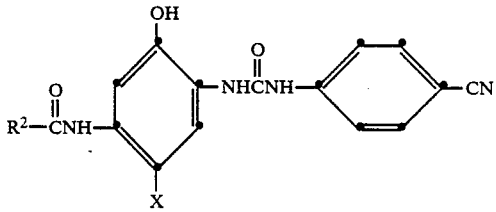

(II)

wherein:

$R^2$ is a ballast group; and

X is hydrogen or a coupling-off group, said coupler component being dispersed in (2) a coupler solvent component which comprises (c) from 1 to about 50% by weight of N,N-diethyllauramide and (d)

from about 50 to about 99% by weight of a dialkyl phthalate compound.

2. The recording material of claim 1 wherein $R^1$ is ethyl.

3. The recording material of claim 1 wherein $R^1$ is propyl.

4. The recording material of claim 1 wherein $R^2$ is:

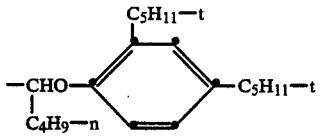

5. The recording material of claim 4 wherein X is hydrogen.

6. The recording material of claim 1 wherein the coupler of Formula (I) comprises from about 70 to about 95% by weight of the coupler component.

7. The recording material of claim 1 wherein N,N-diethyllauramide comprises from about 5 to about 25% by weight of the coupler solvent component.

8. The recording material of claim 1 wherein the dialkyl phthalate is di-n-butylphthalate.

9. The recording material of claim 1 wherein the coupler component of Formula (I) has the structure:

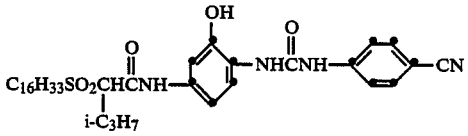

and the coupler component of Formula (II) has the structure:

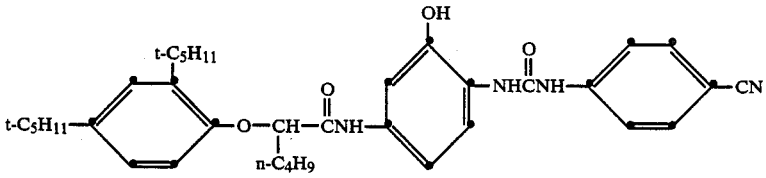

10. A photosensitive silver halide emulsion which has associated therewith (1) a cyan dye-forming coupler component comprising (a) from about 20 to 100% by weight of a sulfone group containing coupler compound having the structural formula:

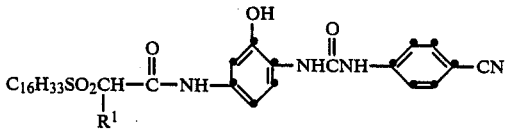

(I)

wherein:

$R^1$ is alkyl having 2 or 3 carbon atoms; and (b) up to about 80% by weight of coupler compound having the structural formula:

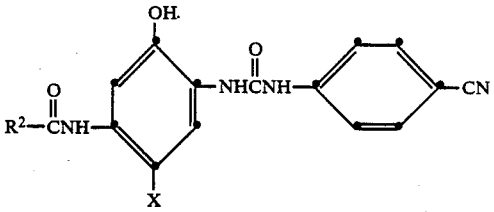

(II)

wherein:

$R^2$ is a ballast group; and

X is hydrogen or a coupling-off group, said coupler component being dispersed in 2) a coupler solvent component which comprises (c) from 1 to about 50% by weight of N,N-diethyllauramide and (d) from about 50 to about 99% by weight of a dialkyl phthalate compound.

11. The emulsion of claim 10 wherein $R^1$ is ethyl.

12. The emulsion of claim 10 wherein $R^1$ is propyl.

13. The emulsion of claim 10 wherein $R^2$ is:

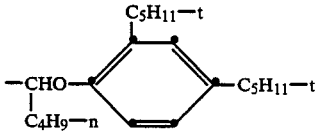

14. The emulsion of claim 13 wherein X is hydrogen.

15. The emulsion of claim 10 wherein the coupler of Formula (I) comprises from about 70 to about 95% by weight of the coupler component.

16. The emulsion of claim 10 wherein N,N-diethyllauramide comprises from about 5 to about 25% by weight of the coupler solvent component.

17. The emulsion of claim 10 wherein the dialkyl phthalate is di-n-butylphthalate.

18. The emulsion of claim 10 wherein the coupler component of Formula (I) has the structure:

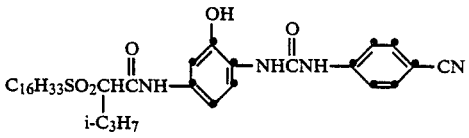

and the coupler component of Formula (II) has the structure:

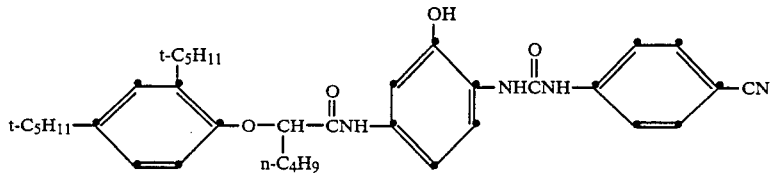
OH
t-C5H11
O
NHCNH
CN
t-C5H11
O
CH
CNH
n-C4H9
* * * * *